US008341854B2

(12) United States Patent
Ogata et al.

(10) Patent No.: US 8,341,854 B2
(45) Date of Patent: Jan. 1, 2013

(54) VACUUM FREEZE-DRYING APPARATUS AND METHOD FOR VACUUM FREEZE DRYING

(75) Inventors: Seiji Ogata, Chigasaki (JP); Kyuzo Nakamura, Chigasaki (JP); Katsuhiko Itou, Chigasaki (JP); Takashi Hanamoto, Chigasaki (JP); Masaki Itou, Chigasaki (JP)

(73) Assignee: Ulvac, Inc., Chigasaki-shi (JP)

( * ) Notice: Subject to any disclaimer, the term of this patent is extended or adjusted under 35 U.S.C. 154(b) by 303 days.

(21) Appl. No.: 12/635,046

(22) Filed: Dec. 10, 2009

(65) Prior Publication Data

US 2010/0107437 A1 May 6, 2010

Related U.S. Application Data

(63) Continuation of application No. PCT/JP2008/060647, filed on Jun. 11, 2008.

(30) Foreign Application Priority Data

Jun. 14, 2007 (JP) ..... 2007-157684

(51) Int. Cl.
*F26B 5/06* (2006.01)
*F26B 13/30* (2006.01)

(52) U.S. Cl. ..... 34/287; 34/288; 34/289; 34/92

(58) Field of Classification Search ..... 34/284, 34/287, 288, 289, 372, 92
See application file for complete search history.

(56) References Cited

U.S. PATENT DOCUMENTS 4,033,048 A * 7/1977 Van Ike ..... 34/92

FOREIGN PATENT DOCUMENTS

| | | | |
|---|---|---|---|
| CN | 101196366 A * | | 6/2008 |
| JP | 45-17516 | | 6/1970 |
| JP | 7-301486 | | 11/1995 |
| JP | 2006-90671 | A1 | 4/2006 |
| JP | 2006-177640 | A1 | 7/2006 |
| WO | WO 00/40910 | A1 | 7/2000 |

OTHER PUBLICATIONS

Office Action dated Aug. 20, 2010 corresponding to Chinese Patent Application No. 200880019864.0 with English translation.
International Search Report for International Application No. PCT/JP2008/060647 dated Sep. 9, 2008.

* cited by examiner

*Primary Examiner* — Jiping Lu
(74) *Attorney, Agent, or Firm* — Kratz, Quintos & Hanson, LLP

(57) ABSTRACT

A vacuum freeze-drying apparatus capable of rapid drying is provided. A cold trap for drying, which is arranged inside a drying chamber, is set to a low temperature of −70 degrees Celsius or below, and heat is supplied to frozen particles on a conveyor belt to a degree such that the frozen particles do not melt. The amount of the liquid component evaporating from the frozen particles increases, and the amount of the liquid component entering the frozen particles decreases so that the time for drying the frozen particles is shortened.

2 Claims, 3 Drawing Sheets

VACUUM FREEZE-DRYING APPARATUS AND METHOD FOR VACUUM FREEZE DRYING

This application is a continuation of International Application No. PCT/JP2008/060647, filed Jun. 11, 2008, which claims priority to Japan Patent Application No. 2007-157684, filed on Jun. 14, 2007. The disclosures of the prior applications are herein incorporated by reference in their entireties.

FIELD OF THE INVENTION

The present invention generally relates to a technical field of vacuum freeze drying, and particularly to vacuum freeze-drying technology capable of rapid drying.

BACKGROUND OF THE INVENTION

Heretofore, vacuum freeze-drying methods have been used in which a solution or a dispersion liquid is sprayed in a vacuum ambience, and a dried solute in the solution or a dispersed material in the dispersion liquid is obtained. In a conventional spray type vacuum freeze-drying apparatus, since it takes a long time to completely sublimate water and completely dry the solute or the dispersed material, the drying time period has been sought to be shortened.

Furthermore, if the temperature around a conveyor tray is raised to be higher than a freezing point of the solution or the dispersion liquid in order to shorten the drying time period, there is a possibility that the objects to be dried, which have been frozen, melt and adhere to each other.

The present invention shortens the time period required in the drying step and prevents the adhesion of the objects to be dried.

A vacuum freeze-drying apparatus is disclosed in Japanese Patent Publication No. 2006-177640, for example.

SUMMARY OF THE INVENTION

An object of the present invention is to provide a vacuum freeze-drying apparatus which has a short drying time period.

In order to solve the above problem, an embodiment of the present invention is directed to a vacuum freeze-drying apparatus that includes a drying chamber, a spraying chamber connected to the drying chamber, a vacuum evacuation system for vacuum evacuating the drying chamber and the spraying chamber, a spraying unit for producing frozen particles by spraying a raw material liquid into an interior of the spraying chamber containing therein a vacuum ambience, a placing section where the frozen particles transferred from the spraying chamber to the drying chamber are placed, a cold trap for drying arranged inside the drying chamber, a cooling unit for cooling the drying cold trap to −70 degrees Celsius or below, and a vacuum pump connected to the drying chamber. The vacuum pump is configured to vacuum evacuate the drying chamber to a pressure of 0.7 Pa or below.

Further, an embodiment of the present invention is directed to the above-described vacuum freeze-drying apparatus which further includes a temperature control unit for controlling the temperature of the frozen particles on the placing section.

The present invention is also directed to a method for vacuum freeze drying. The method includes the steps of cooling a cold trap for drying arranged inside a drying chamber to a temperature of −70 degrees Celsius or below, while an interior of the drying chamber is kept at a pressure of 0.7 Pa or below by vacuum evacuating the interior of the drying chamber, and drying frozen particles placed inside the drying chamber.

Further, an embodiment of the present invention is directed to the vacuum freeze-drying method, wherein the temperature of the placing section where the frozen particles are placed is controlled to be higher than the temperature of the drying cold trap and lower than a temperature at which the frozen particles melt.

As discussed above, the present invention provides a vacuum freeze-drying apparatus having a high drying speed.

DETAILED DESCRIPTION OF THE INVENTION

Figure 1:
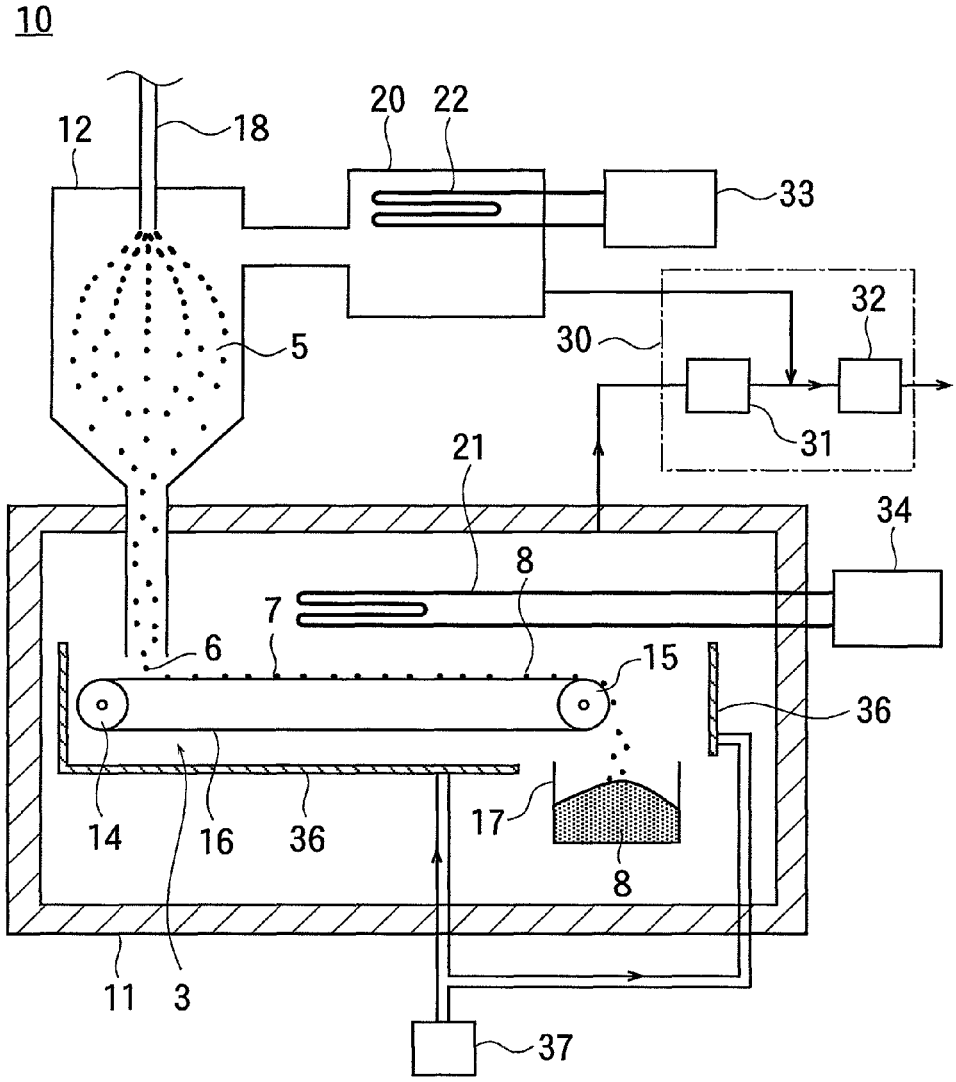
FIG. 1 is a schematic sectional view for illustrating a vacuum freeze-drying apparatus according to an embodiment of the present invention.

FIG. 1 is a schematic sectional view for illustrating the interior of a vacuum freeze-drying apparatus 10 according to an embodiment of the present invention.

Referring to FIG. 1, this vacuum freeze-drying apparatus 10 includes a drying chamber 11 and a spraying chamber 12.

A cooling chamber 20 is connected to the spraying chamber 12. A vacuum evacuation system 30 is connected to the cooling chamber 20 and the drying chamber 11, so that the cooling chamber 20 and the drying chamber 11 are evacuated to a vacuum ambience when the vacuum evacuation system 30 is operated. The spraying chamber 12 is vacuum evacuated via the cooling chamber 20.

A cold trap 22 for freezing and a cold trap 21 for drying are arranged inside the cooling chamber 20 and the drying chamber 11, respectively.

The freezing cold trap 22 and the drying cold trap 21 are connected to the cooling units 33, 34, respectively. When the cooling units 33, 34 are operated in the state that each of the chambers 11, 12, 20 is filled with a vacuum ambience, the freezing cold trap 22 and the drying cold trap 21 are cooled to low temperatures. In an embodiment of the present invention, the drying cold trap 21 is cooled to a temperature lower than the temperature of the freezing cold trap 22.

A spraying unit 18 is air-tightly inserted into the spraying chamber 12. When a misty raw material liquid is sprayed into the spraying chamber 12 through the spraying unit 18 in the state that the interior of the spraying chamber 12 is set in a vacuum ambience at around 100 Pa, the liquid is evaporated from the misty raw material liquid, the raw material liquid is instantaneously cooled, and frozen particles 5 are produced in around 0.1 second.

The raw material liquid includes a liquid component and a solid component, such as a solute dissolved in the liquid component, a dispersed material dispersed in the liquid component or the like. The same solid component as in the raw material liquid is contained in the frozen particles 5.

The liquid component that evaporated from the raw material liquid while being frozen is vacuum evacuated by the vacuum evacuation system 30 via the cooling chamber 20.

The freezing cold trap 22 is cooled to a low temperature of −60 degrees Celsius or below. The pressure of the liquid component contained inside the cooling chamber 20 is equal to the vapor pressure of the liquid component at the freezing cold trap 22 at the maximum, and a portion that exceeds the vapor pressure is removed from the inner ambience of the cooling chamber 20 by adhering to the freezing cold trap 22. Note that the vapor pressure of water at −60 degrees Celsius is about 2 Pa, which corresponds to a reachable pressure of a mechanical type vacuum pump.

On the other hand, the produced frozen particles 5 fall toward a bottom face of the spraying chamber 12. The bottom face of the spraying chamber 12 is in a funnel-like shape, and connected to a ceiling of the drying chamber 11. The frozen particles 5 slide down toward the drying chamber 11 through an opening of the funnel. When the particles enter the interior of the drying chamber 11, they fall down toward the bottom of the drying chamber 11 from the ceiling of the drying chamber 11. The reference numeral 6 denotes the falling frozen particles.

A placing section 3 is provided inside the drying chamber 11. The placing section 3 includes two rollers 14, 15 and a conveyor belt 16. The conveyor belt 16 is annularly stretched between the rollers 14, 15 in such a manner that it is positioned horizontally in an upper stage and two lower stages.

The rollers 14, 15 are connected to a motor not shown. When the rollers 14, 15 are rotated in a predetermined direction by the motor, an upper stage portion of the conveyor belt 16 is moved from the roller 14 at a starting side toward the roller 15 at a terminating side of the placing section 3.

A portion of the conveyor belt at the starting side is positioned under the spraying chamber 12.

The frozen particles 6 falling inside the drying chamber 11 land on the portion of the conveyor belt 16 at the starting side. That is, they get deposited on the portion of the conveyor belt 16 at the starting side.

A reference numeral 7 denotes the frozen particles getting on the conveyor belt 16. The frozen particles 7 on the conveyor belt 16 move together with the portion of the conveyor belt 16 at the upper stage side.

The drying cold trap 21 is arranged above the conveyor belt 16, and the frozen particles 7 on the conveyor belt 16 are faced to the drying cold trap 21, so that the liquid component is removed from an ambience surrounding the frozen particles 7.

Because the temperature of the frozen particles 7 is lower than the melting point of the liquid component, the liquid component evaporates without the frozen particles 7 being melted. Consequently the liquid component is removed from the ambience around the frozen particles 7 so that the frozen particles 7 are dried.

Temperature control units 36 are arranged at a lower position and side positions of the conveyor belt 16.

The temperature control units 36 are connected to a heat medium circulating unit 37 so that a temperature-controlled liquid heat medium is first supplied from the heat medium circulating unit 37, circulated inside the temperature control units 36, and then returned to the heat medium circulating unit 37.

The temperature of the heat medium is controlled to be higher than the temperature of the drying cold trap 21 and lower than a temperature at which the frozen particles 7 melt.

The temperature control units 36 are positioned near the conveyor belt 16, and a vaporization heat with which the liquid component is evaporated from the frozen particles 7 on the conveyor belt 16 is supplied by a radiation heat and a convection heat from the temperature control units 36. The sublimation of the liquid component of the frozen particles 7 is accelerated by the supplied heat.

On the other hand, the drying cold trap 21 is cooled to a low temperature of −70 degrees Celsius or below, and the pressure of the liquid component in the inner ambience of the drying chamber 11 is set to a low pressure. Thereby, the number of molecules of the liquid component entering the frozen particles 7 is reduced, so that the drying of the frozen particles 7 is accelerated.

Although the ambience surrounding the frozen particles 7 is at −70 degrees Celsius, the frozen particles 7 on the conveyor belt 16 is supplied with the heat from the temperature control units 36 through the conveyor belt 16. Therefore, the temperature of the frozen particles 7 is higher than the temperature of the surrounding ambience, and the frozen particles 7 are conveyed toward the roller 15 at the terminating side by the conveyor belt 16 while the liquid component is evaporating. The temperature control units 36 are controlled such that the temperature of the frozen particles 7 on the conveyor belt 16 may not exceed the melting point of the liquid component.

The liquid component that evaporated from the frozen particles 7 is removed by the vacuum evacuation system 30, including the liquid component that was once attached to the drying cold trap 21. The pressure of the liquid component contained in the inner ambience of the drying chamber 11 is the vapor pressure of liquid component at the temperature of the drying cold trap 21 or below.

As discussed above, the frozen particles 7 are supplied with the heat from the placing section 3 so that the frozen particles 7 are heated without being melted, almost up to a temperature at which they melt. Consequently, the difference in temperature between the frozen particles 7 and the surrounding temperature is set larger than that in the conventional vacuum freeze-drying method. That temperature difference accelerates the evaporation speed of the frozen particles 7, and accomplishes the rapid drying.

A container 17 is arranged under the terminating point of the movement of the conveyor belt 16 on the upper side. When the frozen particles 7 are conveyed to reach the terminating position by the conveyor belt 16 while being dried, the conveyor belt 16 is turned from the upper side to the lower side in order to drop the frozen particles 7 into the container 17.

The frozen particles 7 are completely dried by the rapid drying before being dropped so that they are converted to dried particles 8 composed of the solid component such as a solute, a dispersed material or the like containing no liquid component. The dried particles 8 turn together with the conveyor belt 16, fall at the terminating position and are received inside the container 17.

In this case, the frozen particles 5, 6 at the time of the production are of spherical shapes having diameters of around 100 μm to 1 mm. When the liquid component of the dried particles 8 is sublimated and the dried particles are completely dried, it is observed that the dried particles 8 are converted to sponge-like spherical bodies having the almost same sizes as the sizes of the frozen particles 5, 6 at the time of the production.

The principle of vacuum drying the frozen particles 7 in the vacuum freeze-drying apparatus 10 as in an embodiment of the present invention will be explained.

The frozen particles 7 on a conveyor belt 16 during drying undergo the heat conduction through the conveyor belt 16 and the supply of the heat with the liquid component which enters from the ambience surrounding the frozen particles 7. On the other hand, a latent heat (vaporization heat) is captured from the frozen particles 7 during the drying through the sublimation of the liquid component (heat balance).

Further, the sublimated (evaporated) liquid component is lost from the frozen particles 7, whereas the liquid component is fed by the liquid component which enters into the frozen particles 7 from the surrounding ambience (material balance).

The amount of the liquid component sublimated from the frozen particles 7 is proportional to the vapor pressure of the liquid component at the temperature Ti of the frozen particles 7, and the amount of the entering liquid component is proportional to the pressure of the liquid component in the surrounding ambience.

The higher the temperature, the larger is the vapor pressure. Thus, in order to increase the sublimated amount of the frozen particles 7, only the temperature of the frozen particles has to be raised.

On the other hand, the temperature of the drying cold trap 21 is lower than the temperature of the frozen particles 7, and the pressure of the liquid component contained in the surrounding ambience is the vapor pressure of the liquid component at the temperature of the drying cold trap 21 or below. Therefore, in order to reduce the entering amount of the liquid component into the frozen particles 7, only the content of the liquid component contained in the surrounding ambience has to be reduced by lowering the temperature Tc of the drying cold trap 21.

In order to shorten the drying time, only the entering amount of the liquid component has to be reduced by increasing the sublimated amount. Therefore, according to one embodiment, in order to shorten the drying time, it is ultimately necessary that the temperature of the frozen particles 7 is raised and the temperature of the drying cold trap 21 is lowered.

If the temperature of the frozen particles 7 reaches the freezing point of the liquid component or higher, there is a possibility that the frozen particles 7 melt and the resulting frozen particles 8 adhere to each other. Accordingly, it is necessary to maintain the frozen particles 7 at a temperature lower than the melting temperature of the liquid component. For this purpose, it is desirable that the temperatures of the conveyor belt 16 and the wall of the drying chamber 11 are maintained at temperatures of the freezing point of the liquid component or below.

Figure 2:
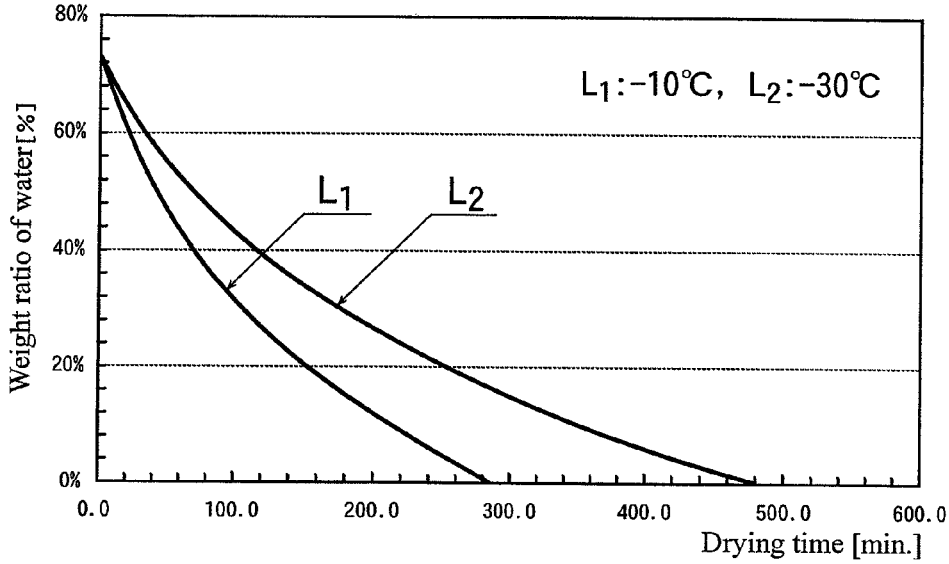
FIG. 2 is a graph for explaining effects on the required drying time period depending on the use of different conveyor belt temperatures.

FIG. 2 is a graph showing the relationship between the content of water and the drying time when the temperature of the conveyor belt 16 was changed in the state that the temperature of the drying cold trap 21 was set to −60 degrees Celsius. A curve $L_1$ corresponds to a case in which a temperature Tt of a conveyor belt was −10 degrees Celsius, and a curve $L_2$ corresponds to a case in which it was −30 degrees Celsius. The higher the temperature of the conveyor belt 16, the shorter is the drying time.

Figure 3:
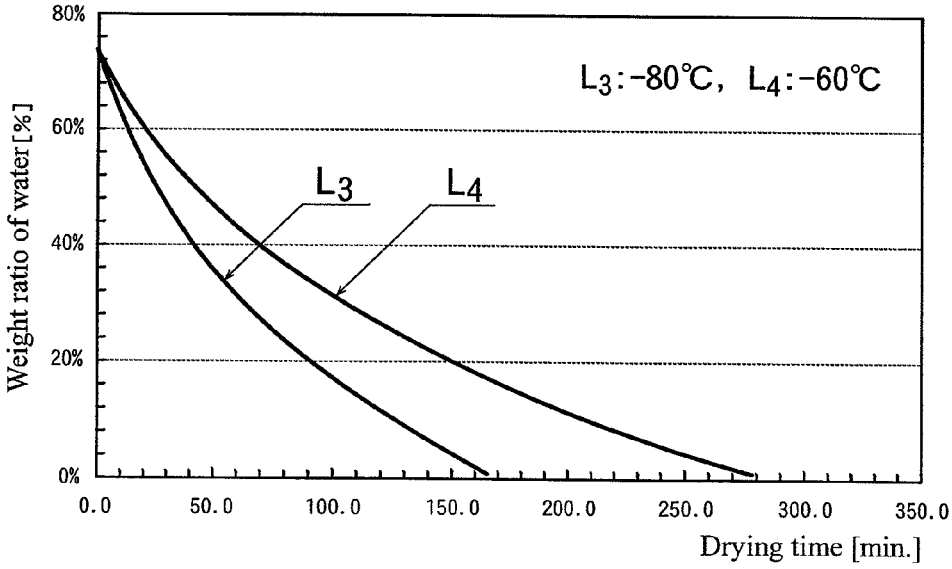
FIG. 3 is a graph for explaining effects on the required drying time period depending on the use of different temperatures for a cold trap for drying.

FIG. 3 is a graph showing the relationship between the content of water and the drying time when the temperature of the drying cold trap 21 was changed in the state that the temperature of the conveyor belt 16 was set to −10 degrees Celsius. A curve $L_3$ corresponds to a case in which the drying cold trap 21 was at −80 degrees Celsius, and a curve $L_4$ corresponds to a case in which it was at −60 degrees Celsius.

Figure 4:
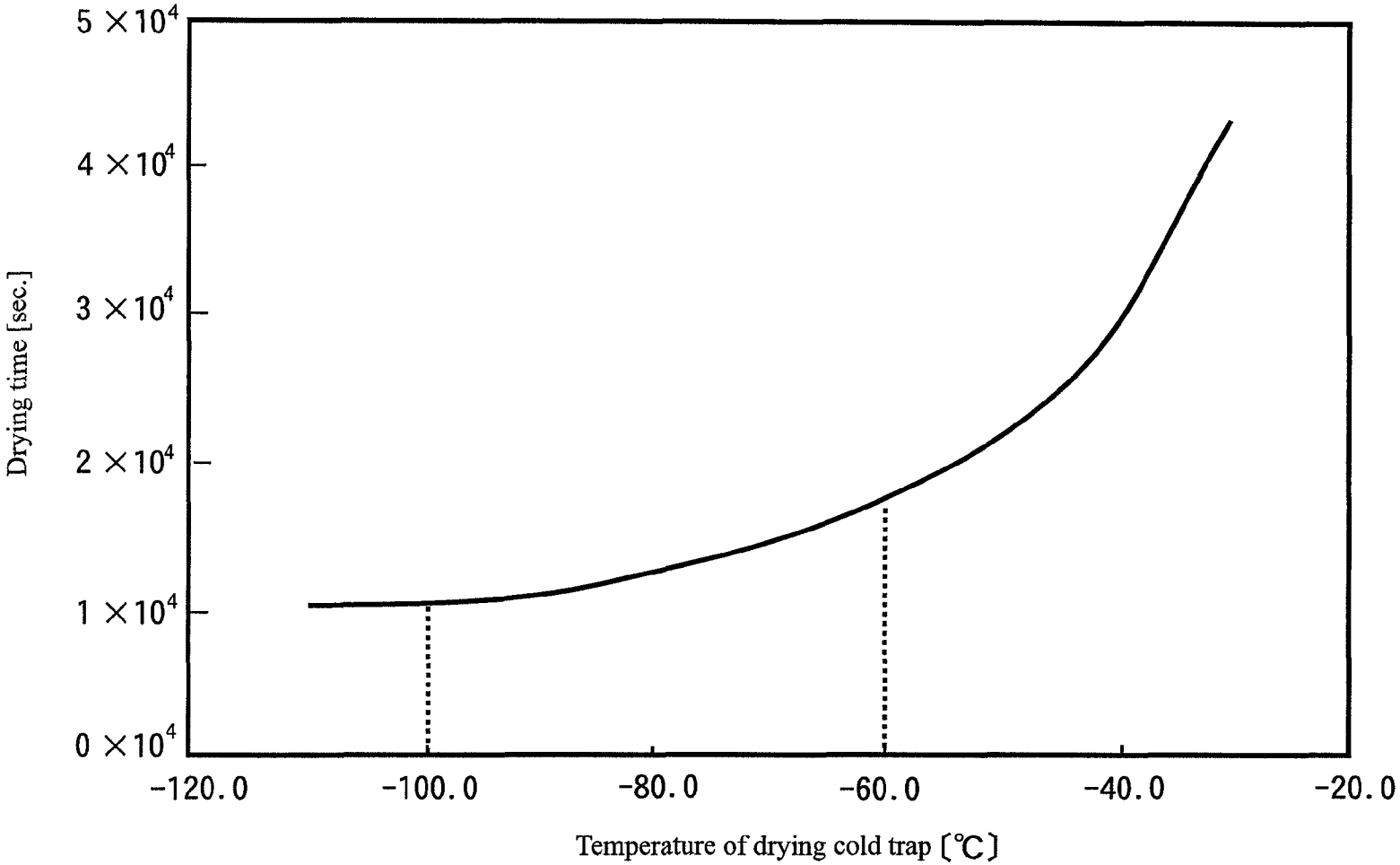
FIG. 4 is a graph for explaining the relationship between the temperature and the drying time of the drying cold trap.

FIG. 4 shows to the relationship between the temperature of the drying cold trap 21 and the drying time when the temperature of the drying cold trap 21 was changed in the state that the temperature of the conveyor belt 16 was set to −10 degrees Celsius. The lower the temperature of the drying cold trap 21, the shorter is the drying time.

In the above, the frozen particles 7 used for calculation were spherical bodies having a radius of 50μ, and the liquid component was water.

It is assumed that the solute remains through the sublimation of solid of the liquid component (ice in this case), and the dried particles 8 become small concentric spheres, while the dried particles are shrunk in the state that the same shapes of the frozen particles 7 are maintained.

In addition, the heat conduction from the conveyor belt 16 to the frozen particles 7 is approximately inversely proportional to the thickness of the dried solute.

In calculations, the temperature Ti of the frozen particles 7 was taken as a variable. However, calculation results revealed that a difference between the temperature Ti of the frozen particles 7 and the temperature Tc of the drying cold trap 21 was as low as 1 degree or below, excluding a case where Tc was extremely low and a case where the particle diameters were extremely small. Therefore, it is considered that the frozen particles 7 are in thermal equilibrium with the drying cold trap 21.

Meanwhile, although the freezing point decreases in proportion to the molar ratio of the solute to the solvent, the influence in the depression of the freezing point is small. When the liquid component is water, the freezing point is about −5 degrees Celsius when the molar ratio is 5%.

The above-discussed temperature control unit 36 has a construction such that the liquid heat medium is circulated. However, it may be made up of an electric device utilizing a Peltier effect without using the heat medium and the temperature can be controlled electrically.

Note that in order to maintain the interior of the drying chamber 11 at a pressure lower than the saturated vapor pressure of the liquid component, the reachable pressure of the vacuum evacuation system 30 needs to be set lower than the vapor pressure of the liquid component at the temperature of the drying cold trap 21.

Since the vapor pressure of water at −70 degrees Celsius is about 0.7 Pa, that at −80 degrees Celsius is about 0.1 Pa, and that at −90 degrees Celsius is about $10^{-2}$ Pa, the reachable pressure of the vacuum evacuation system 30 needs to be at a pressure lower than 0.7 Pa so as to set the temperature of the drying cold trap 21 to −70 degrees Celsius or lower.

The vacuum evacuation system 30 in an embodiment of the present invention is configured such that between a main evacuation unit 32 and the drying chamber 11 is provided an auxiliary evacuation unit 31 having a lower reachable pressure less than 0.7 Pa, and its back pressure is vacuum evacuated by the main evacuation unit 32. In this configuration, a mechanical type booster pump or a turbo molecular pump having a low reachable pressure can be used as the auxiliary evacuation unit 31 so that the temperature of the drying cold trap 21 can be easily set to −70 degrees Celsius or below.

In addition, although the frozen particles 7 were dried in the above example in the state that they were placed on the conveyer belt 16, they may be dried in the state that they are place on an immovable tray.

What is claimed is:

1. A vacuum freeze-drying apparatus, comprising:

a drying chamber;

a spraying chamber connected to the drying chamber;

a vacuum evacuation system for vacuum evacuating the drying chamber and the spraying chamber;

a spraying unit for producing frozen particles by spraying a raw material liquid into an interior of the spraying chamber which is a vacuum ambience, a placing section where be frozen particles transferred from the spraying chamber to the drying chamber are placed, a cold trap for drying arranged to face the frozen particles on the placing section inside the drying chamber, a first cooling unit for cooling the drying cold trap to −70 degrees Celsius or below, a vacuum pump provided to the vacuum evacuation system and connected to the drying chamber and the vacuum pump vacuum evacuates the drying chamber to a pressure of 0.7 Pa or below, a cooling chamber connected to the spraying chamber;

a cold trap for freezing arranged inside the cooling chamber; and a second cooling unit for cooling the freezing cold trap to −60 degrees Celsius or below, wherein a temperature of the placing section is controlled by heating to be higher than a temperature of the drying cold trap and to be lower than a temperature at which the frozen particles melt, and wherein the drying cold trap is cooled to be a temperature lower than a temperature of the freezing cold trap.

2. A method for vacuum freeze drying, the method comprising the steps of placing frozen particles on a placing section inside a vacuum evaporated drying chamber, cooling a cold trap for drying arranged inside a drying chamber to the temperature of −70degrees Celsius or below and arranging the drying cold trap to face the frozen particles placed on the placing section, while an interior of the drying chamber is being kept at a pressure of 0.7 Pa or below by vacuum evacuating the interior of the drying chamber and controlling a temperature of the placing section by heating to be a temperature higher than a temperature of the drying cold trap and lower than a temperature at which the frozen particles melt at the same time, drying frozen particles placed on the placing section inside the drying chamber;

generating the frozen particles by spraying raw material liquid inside a spraying chamber, while cooling a cold trap for freezing arranged inside a cooling chamber, which is connected to the spaying chamber, conveying frozen particles into the drying chamber from the spray chamber, and wherein the temperature of the drying cold trap is controlled to he lower than a temperature of the freezing cold trap.

* * * * *